United States Patent [19]

Kaczkowski et al.

[11] Patent Number: 4,850,177

[45] Date of Patent: Jul. 25, 1989

[54] STRETCH BUNDLER

[76] Inventors: James W. Laczkowski, 10865 Bodine Rd., Clarence, N.Y. 14031; Kevin A. Bickerstaff, 168 Northwood Ave., West Seneca, N.Y. 14224

[21] Appl. No.: 292,246

[22] Filed: Dec. 30, 1988

[51] Int. Cl.[4] ..... B65B 13/14

[52] U.S. Cl. ..... 53/556; 53/588

[58] Field of Search ..... 53/139.3, 556, 582, 53/588, 589; 100/33 P B

[56] References Cited

U.S. PATENT DOCUMENTS

| | | | |
|---|---|---|---|
| 3,233,385 | 2/1966 | Lyon | 53/588 |
| 4,110,957 | 9/1978 | Lancaster et al. | 53/556 X |
| 4,483,124 | 11/1984 | Ohba et al. | 53/588 X |
| 4,553,374 | 11/1985 | Lancaster et al. | 53/588 X |
| 4,575,994 | 3/1986 | Takami | 53/582 |
| 4,761,934 | 8/1988 | Lancaster | 53/588 X |

*Primary Examiner*—Robert L. Spruill
*Assistant Examiner*—Beth Bianca
*Attorney, Agent, or Firm*—James J. Balabate

[57] ABSTRACT

This invention relates to a stretch bundler having a novel film-holding device. The bundler has a rotable ring that holds the film in a spool and as it rotates it wraps the film around the object to be wrapped or bundled. The film is held at the beginning of the process by a device that firmly holds the sides of the film and stretches these sides outwardly. The subsequent wraps of film are thereby free of any obstructions.

18 Claims, 2 Drawing Sheets

STRETCH BUNDLER

This invention relates to a bundling machine and, more particularly, to a novel bundling machine utilizing stretch film or stretch tape.

BACKGROUND OF THE INVENTION

It is known to wrap or bundle packages or other objects by the use of narrow bands of stretch film. Stretch bundling is used to ease handling and to close a container, box or the like. The elasticity of the band or web holds the package closed while additional bands are rotated around the closed package. The effectiveness of stretched plastic film in holding a package together is a function of the force placed upon the package and the strength of the plastic film applied therearound. The use of narrow bands of material to stretch bundle has been limited generally to hand applications. That is, the package to be closed or wrapped is contacted with a stretch film or tape and hand wound over itself around the package. Since hand wrapping is relatively expensive there is needed an automated system with means to enable continuing applications of separate wraps or bands to the same package to be bundled or closed.

There are also known various types of machines for packaging articles but none of them disclose the use of an automatic stretch bundler of the type disclosed in the present invention. In U.S. Pat. No. 4,537,009 (Kreamer) a method and apparatus for packaging articles such as fruit is disclosed. In the Kreamer apparatus two portions of film which are fed between annular film clamping means are used. An outer clamping mechanism of Kreamer firmly clamps the film portions while stretching the film over the article. This type machine as described by Kreamer utilizes two separate sheets of film to encapsulate fruit in a sealed environment. This machine cannot be used to apply bands of film or tape around an item to be bundled.

The McDowell U.S. Pat. No. 4,545,182 discloses a wrapping system for circular or spiral wrapping by movement of the item during wrapping. McDowell's apparatus comprises a rotating ring which carries a film dispenser adapted to dispense film web or tape spirally around an item to be wrapped. The package 24 of McDowell is placed upon a conveyor means 31 which moves the package 24 downstream as it is wrapped. The conveyor delivers the package 24 into a wrap area 40 atop wrapping conveyor 32 around which rotates film dispensing apparatus 42. The film dispensing apparatus 42 of McDowell comprises a ring-shaped film support member 44 rotably mounted and supported by rollers 52. As conveyor 32 moves package 24 it is spirally wrapped and transported downstream where it is removed after wrapping. Other wrapping systems such as spiral wrapping are disclosed in the July 1985 issue of *Material handling Engineering*. Basically, these spiral wrapping machines wrap the article by use of a stretch tape which is rotated around the article in a spiral fashion until substantially the entire outer surface of the article is wrapped. In the *Material Handling Engineering* article an overhead spiral wrap machine sometimes called a rotary tower wrapper is disclosed. This type wrapper pays out pre-stretched 20–30 inch wide film around the load or article as the load sits on a conveyor or towline cart.

In U.S. Pat. Nos. 4,549,388 and 4,676,048 (Lancaster) an orbital wrapper with friction drive is disclosed. Lancaster teaches that "after each load is wrapped in a continuous spiral mode, the conveyor assembly is stopped and the spiral film web located between the loads is guided by guide members of the sealing and cutting mechanism into a small sealing area where the film web is clamped together, sonically sealed and severed". The Lancaster system does not wrap the load several times around the same peripheral portion of the load such as in a bundling operation.

In U.S. Pat. No. 4,674,269 (Denda) a wrapping machine is disclosed wherein a stretchable film means is used together with means to lift an article or load to be wrapped. The article lifting means is adapted to raise an article to be wrapped into taut engagement with the film extended at a predetermined position. This type machine is quite complex and expensive and does not use strips or tapes of stretchable film but rather large folds or sheets of stretchable material.

In U.S. Pat. No. 4,723,393 (Silbernagel) discloses a process and apparatus for an orbital stretch wrapper to form two layers of opposite pitch on items or bundles. The Silbernagel patent teaches the use of a first and second wrap roll for spiral wrapping of a load. The rolls are placed successively along the length of a conveyor belt separated by at least one width of film. The Silbernagel patent does not teach the application of a plurality of single bands of stretch film or tape around a load in a single location to thereby bundle the load.

SUMMARY OF THE INVENTION

It is therefore an object of this invention to provide a bundling system devoid of the above-noted disadvantages.

Another object of this invention is to provide a bundling system that is relatively easy to use and wherein the entire surface of the bundle is securely held in place.

Another object of this invention is to provide a novel bundling system wherein the use of adhesives, strings, wires and the like are eliminated thus reducing packaging costs.

Still another object of this invention is to provide a novel bundling system which is consistent and fast and wherein labor costs are reduced significantly.

Yet another object of this invention is to provide a novel bundling system wherein the wrapped product is clean and neat and is cosmetically appealing.

Yet still another object of this invention is to provide a wrap over the surface of the wrapped container that holds firmly during vibration in transit.

Another still further object of this invention is to provide a novel bundling system that is usable to wrap loads of odd contours or irregular shapes.

Still yet a further object of this invention is to provide a stretch wrap system not requiring heat but is rather mechanically applied.

Still yet another (important) object of this invention is to gently and firmly secure bundles of soft or fragile objects or materials.

These and further objects of this invention are accomplished generally speaking by providing a stretch bundler having a frame, a rotatable ring and a film dispenser attached to said ring. The dispenser is in the form of a spool or roll means rotably mounted on the ring. The ring is supported by a plurality of stabilizing wheels which keep the ring on an even rotation around a load. The dispenser ring can be constructed of any suitable metal or plastic. A friction wheel drive is positioned in contact with the ring and rotates the ring upon command around a load. The friction wheel is driven by a motor which is suitably connected to the friction wheel by any appropriate means such as a chain or belt or the like. Drive means may also consist of a friction belt or toothed belt or chain around the ring driven by a pulley or sprocket, wherein the ring may have a drive groove or teeth around its periphery or the ring may have gear teeth so as to be directly driven by a drive pinion gear. Such drives are commonly used in the family of equipment known as orbital stretch wrappers and in which group this invention may be generally included. As noted, the ring has movably mounted therein a dispenser spool which is adapted to receive, hold and dispense a film material. Positioned inside the ring is a load platform or shelf parallel with the ground adapted to hold the stationary load in position during wrapping or bundling. The shelf or load platform has an opening in its center portion extending horizontally along its entire length to permit passage of the film. The rotating ring is on a plane perpendicular to the load platform and movably encircles said platform when in operation. The terms "film" and "Tape" will be used interchangeably throughout the specification and claims. The film dispenser is adapted to dispense film around the load as the ring is rotated around said load. Beneath the load platform is located a novel gripper mechanism. The gripper mechanism holds the loose end of the narrow band of stretch film extending from the dispenser and permits the bundling process t begin. Similar controls and mechanism of this type bundler are disclosed in the above-noted article in *Material Handling Engineering* pages 97–100, July 1985 Edition. As the ring rotates around the load, film web or narrow bands of stretch film is drawn to the load by the gripper means holding the loose end of the film below the load. As rotation of the ring continues, the narrow band of film is continuously wrapped around the load, each wrap superimposed upon the previous band. Stabilizing wheels are held against the ring to keep it in movable alignment during the rotation cycles. The ring can conveniently be programmed to rotate to accomplish at least two wraps and then a cutter mechanism cuts the band of film so that the load can be removed. The device relies on certain inherent properties of the stretch film in order to start and finish the application, and to hold and cut and retain the end of the roll of film, is started by securing the beginning end of the film into the holding device by use of programmed controls which also control all automatic functions by means of a program. When the beginning end is secured and an object or load is in place to be wrapped, a motorized rotating carrier device is caused, by the programmed controls, to carry the roll of film and dispenser around the object a number of times as determined by an operator setting of the controls. A key novel feature of the machine is that the holding device consists of two grippers which first grip the film at the edges and then pull apart outside of the width of the film and clear of the path of further wraps of the film. Once that more than one full wrap has been applied, the grippers then release the beginning end of the film which is now retained by the first overwrap. It is therefore the nature of the machine that more than one full wrap must always be applied but this is also a requirement of any application of stretch film wherein a permanent seal is normally not applied, instead the cling provides an adhesive tackiness between multiple wraps, securing the wrap to its surface.

While the film is being applied, the object or load may be held manually or by some clamping means. When the last of the predetermined wraps has begun around past the point of origin at the grippers, then plates which are in fact gripper anvils and are an integral part of the gripper's assembly are extended to close together across and outside of the stretch band around the object. The final wrap, being brought around again by the roll carrier now wraps over the anvils, separated from the preceding wraps. The gripper pads are caused to close onto the anvils holding the film.

A heated blade is caused to pivot in and cut only the last wrap of film band now held in the grippers. A heated pad can be preferably used which is attached to the blade and presses the free end against the film band on the object where it is held by the natural cling of the film. Heated pad increases the cohesive properties of the film at the closure point. Though not melted, the stretch tape's surface temperature is rapidly increased which increases the material's cling. The blade retracts and the film banded object is now free to be removed or moved for application of another band. The objects may be moved manually or automatically, depending on the product requirements and on the provisions for automatic handling.

The beginning end of the roll of film remains held in the grippers. The rotation of the film roll around the object location will normally pause or slow while the object is being replaced or moved. If product handling requires higher speeds, the roll may be continually carried around and a fingerlike rod will be caused to intercept and hold the film down momentarily (in place of the object) while the object is moved.

As above noted, the leading end of a dispenser mounted roll of stretch film is held to the product or load to be bundled and the dispenser is rotated as the unwinding roll of film is stretched by an adjustable brake used to stretch the film as it is applied to the bundle. At the end of the wrap cycle, the film is cut from the roll and wiped against the bundle where cling holds it in place. The result is a bundle unitized by stretch film around the periphery of the bundle. The film can also be stretched in the opposite direction around the periphery for further security in shipment.

A film that can be used is a linear low density extruded Polyethylene Other suitable films may be used if desired and as developed. The requirements of the film are strength, ability to stretch and retain tension and to cling to itself, thus eliminating the need for adhesives or heat sealing. The film by nature will not cling to any other surface and leave residue or tear off a printed surface when it is removed.

Present films are available in widths of 1"–6", so that the width will satisfy the bundling requirements.

The novel stretch film gripper assembly comprises two pivotly-mounted gripper arms, two movable anvils and air cylinders for controlling the movement of the anvils and gripper arms. The air cylinders are all by BIMBA Mfg. Co. FLAT-1 Series. The wrapper designated as Model #160, as described in the patent application, has five pcs. of BIMBA No. FO-09-1.5-2R, for all actuations (two anvils; two grippers; one cutter). The newer wrapper model #100 uses two pcs. of BIMBA No. CFS-00158-A which is a special dual cylinder for anvil and gripper action combined on one mount. It also uses one pc. of a model No. FO-04-1.0-1-MTS for the cutter. Note that other competitive brands of air cylinders could be used and that other mechanical, motorized and electrical actuators could be constructed for the same purpose. Air cylinders, however, are the preferred means of actuation: for low cost, simplicity, power, speed and diversity of uses and programmability.

At the outset, opposing gripper arm pads grab outside edge of stretch film between anvil plate and pad assemblies. The anvils and pads retract pulling film taut between them. This operation is not unlike grabbing the stretch film with your fingers; the thumb works as the anvil opposed to the index finger as the pad. With the stretch film firmly gripped, your hands retract slightly stretching the stretch film between them. This action holds the film firmly in place and stretches the film beyond its normal width allowing the roll of stretch film to be carried around the product bundle by the orbital carriage as many times as the operator or the programmable controller requires. Holding the tail end of the film firmly is necessary so that the orbital action of the carrier stretches the initial layer film in a linear fashion which is desired given the properties of stretch films. After the first wraparound the bundle is completed and the tail end of the film is secured, the gripper pad releases the film and withdraws as more than one wrap is applied. In preparation for the knife/press pad mechanism completing the wrap process, the anvil plates intercept the wrap of film preceding the final wrap of film. The anvil mechanisms are actually thin plates which allow them to close on the next to last wrap separating the final wrap from the preceding wraps and oppose the gripper pads which then close on the last wrap securing it for the process to begin again. This action is not unlike wrapping an object with cellophane. One must hold the lead edge of film as the roll is carried around the object. It is not necessary nor desirable to hold the tail end of film after the first wrap is completed as the material will now hold itself in place. After the desired number of wraps is in place the roll of cellophane or stretch film is cut free from the now firmly wrapped object by appropriate means and the cellophane or stretch film is re-gripped ready to begin the process again.

The gripper mechanism has considerable advantages to the "hand example". Its unique design allows it to firmly grip and stretch the stretch film and then regrip as required. This process is timed and controlled by the proprietary program contained within the programmable controller of the wrapper of the present invention.

The stretch tape used in the apparatus of this invention is generally a film that is a linear low density extruded Polyethylene obtained from Borden Chemical Co., Mobil Chemical Co., Bemis Co. and Stretch Tape Inc.

As above noted, by use of the novel gripper assembly, the film is gripped and stretched transversely to the direction of wrap so as to move the grippers out from the path of the web and thus allow completion of more than one full wrap without encountering the grippers on the subsequent passes. These grippers will release the web after the web has been secured by a sufficient partial overwrap, i.e. 25% of the second pass around the wrapped load or object. The grippers move back in to recapture the web at the final pass prior to cutting the film.

DETAILED DISCUSSION OF THE DRAWING AND PREFERRED EMBODIMENTS

Figure 1:
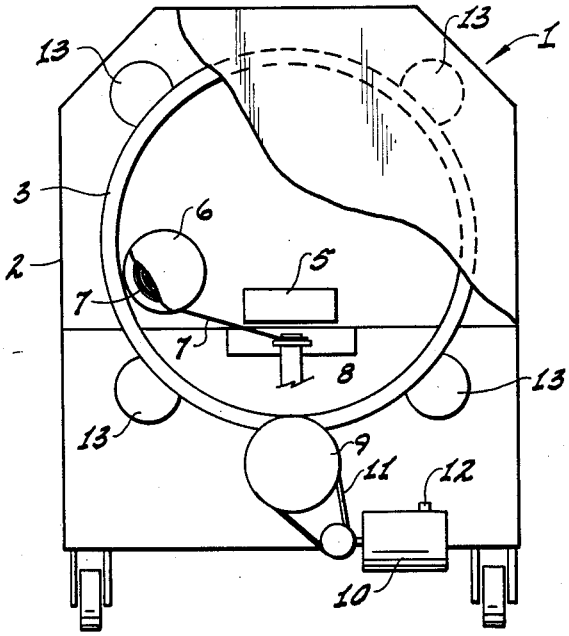
FIG. 1 is a side elevational view of the film dispensing mechanism and bundler of this invention.

In FIG. 1 the entire stretch bundler 1 is illustrated. The bundler has a main frame 2 and rotably attached to frame 2 is rotatable wrapping ring 3. Ring 3 is adapted to rotate 360° around load platform 4. Located inside the ring 3 is a load platform 4 adapted to hold a load or object 5 to be wrapped or bundled. Attached to the inside peripheral portion of ring 3 is a dispensing spool or film dispenser 6. The film dispenser may be any suitable known mechanism adapted to dispense film web around the load. Preferred for dispenser 6 is a spool mechanism for unreeling and feeding the stretchable film from a continuous web of film supply rolls. The wrap operation is begun by gripping the loose end of film 7 by the novel gripper assembly 8. Once the film is held fixed below the load by the gripper assembly 8, the ring 3 is rotated clockwise around load 5 thus allowing the web or film 7 to unwind from dispenser 6 thereby wrapping film 7 completely around the outer portion of object or load 5. Wheel or ring 3 is driven by a drive wheel 9 which is in friction contact with ring 3. Drive wheel 9 is powered by a motor 10 which in turn is connected to any suitable source of energy. Motor 10 can be a DC motor or an AC motor with braking means. Motor 10 may also be provided with a brake and a clutch for purposes such as for high speeds and rapid cycling. The drive wheel 9 can be attached to motor 10 by a belt or chain 11. Connected to motor 10 is activating means 12 which can be pressed or otherwise switched on to activate drive wheel 10 which in turn rotates ring 3. Activating means 12 can be a foot pedal, button or other suitable means. The motor can be driven by any source of power such as electricity, battery, etc. Stabilizing wheels 13 are used to keep ring 3 in alignment as it rotates around load 5. Stabilizing wheels or rollers 13 may have flanges to guide the ring or other separate guides such as strips or low friction materials (UHMW, Teflon, felt) may be used to help contain and guide the ring. The stabilizing wheels 13 can be grooved, fitting the outer peripheral portion of ring 3 therein or they can be solid rubber or other appropriate materials that are in friction contact with ring 3. The important function of stabilizer wheels 13 is that they maintain ring 3 on a uniform, even and level rotating orbit path around load 5. Spools of stretch film 7 can be easily loaded and unloaded on or in film dispenser 6 in any conventional and known way. It is critical to the present invention that gripper assembly 8 firmly hold the film strip 7 below the load 5 at the initiation of the bundling process. Shelf or load platform 4 has an opening or separation 14 across its entire surface through which the tape 7 fits as it is rotating around load 5. Separation 14 can be seen in FIGS. 2–7 herein.

Figure 2:
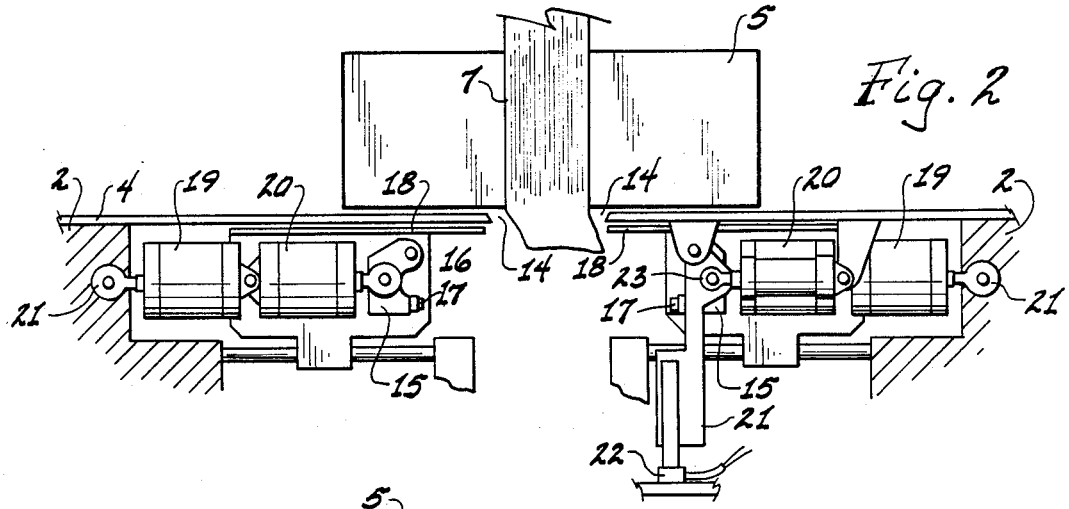
FIG. 2 is a front plan view of the novel gripper mechanism before the film band is introduced into the system with grippers and anvil plates in rest positions.
Figure 3:
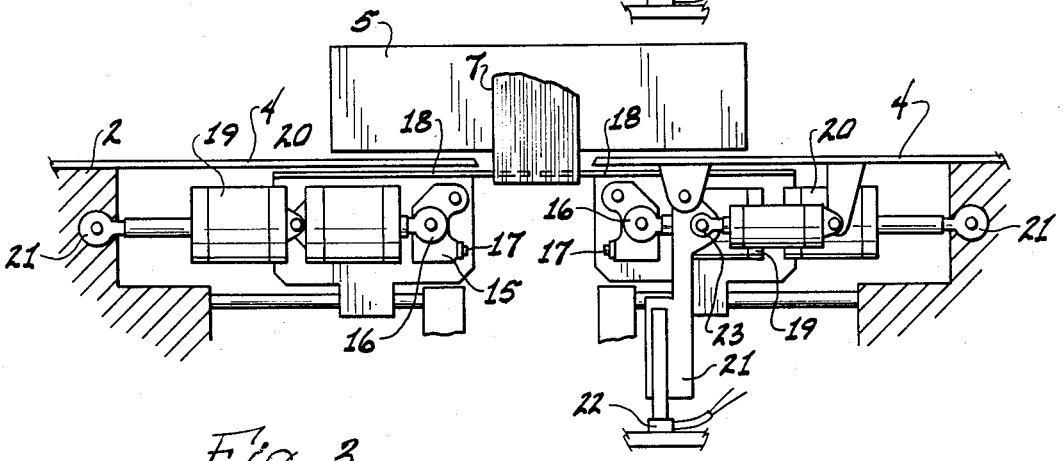
FIG. 3 is the same front plan view with the anvil plates extended to contact the film band but the grippers are in the rest position.
Figure 4:
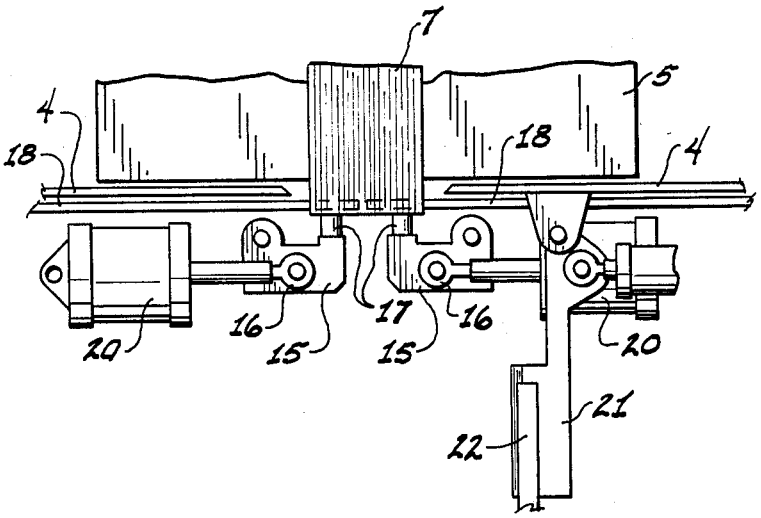
FIG. 4 is the same front plan view with the anvil plates extended and the grippers activated to sandwich the film band therebetween.
Figure 5:
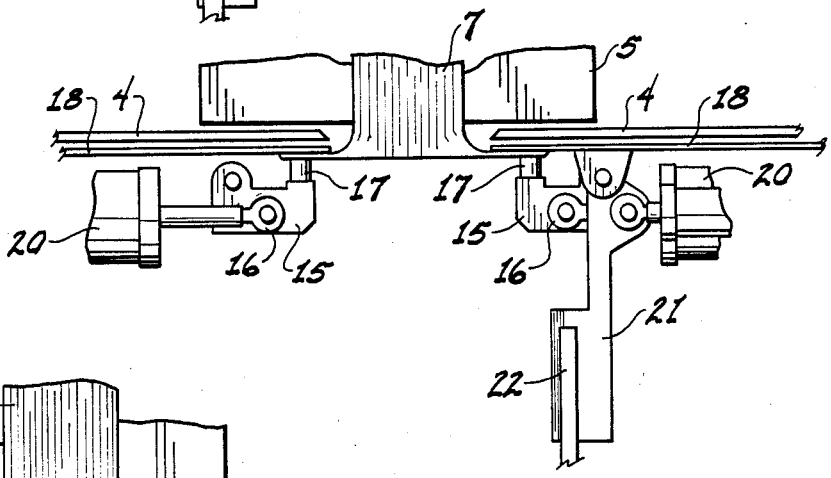
FIG. 5 is the same front plan view with both the grippers and anvil plates retracted thereby stretching the film band.
Figure 6:
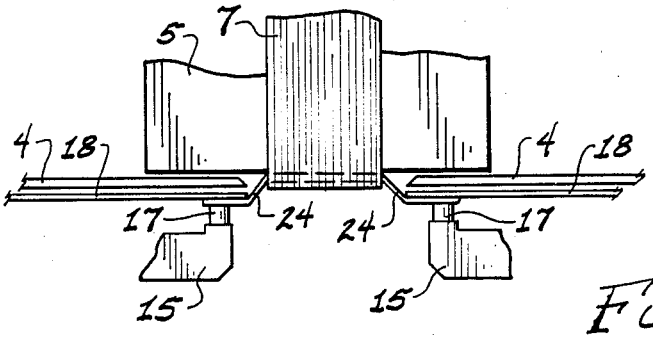
FIG. 6 is this same front plan view after at least one wrapping of the film band around the load or object to be wrapped.
Figure 7:
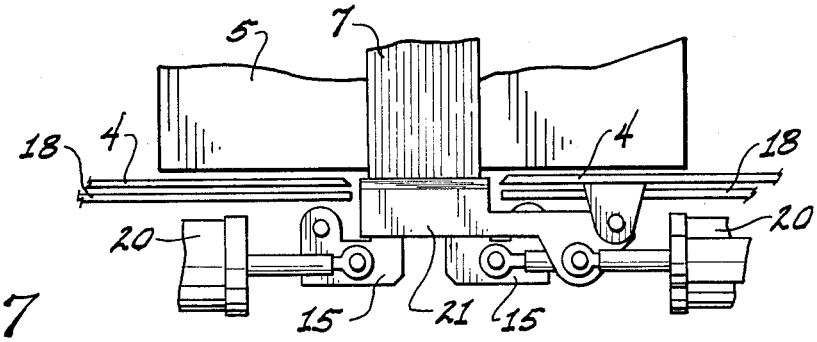
FIG. 7 is this same front plan view after the wrapping is completed and the knife cuts the film band free from the load or object to be wrapped.

In FIG. 2 the gripper assembly 8 is shown illustrating all of the components in a rest position. Gripper arms 15 are mounted on a focal means 16 which is adapted to move gripper pad 17 upward to contact the bottom of film strip 7 when holding strip 7 in position (see FIG. 4). FIG. 2 shows both gripper pads 17 in the down or rest position and anvil plates 18 in the open or rest position. Knife blade 21 is also in the rest position in heat contact, with heater 22. Air cylinder 19 is adapted to move anvil plates to the open and closed (as in FIG. 4) positions. Air cylinder 20 is adapted to move gripper arms 15 to the down and up (as in FIG. 4) positions, that is, can move gripper arms vertically and horizontally. These air cylinders are manufactured by Bimba Inc. and are identified as model no. 160 (5) FO-09-1.5-2R-Model 100 (2) CFS-00158-A. Both cylinders 19 and 20 are mounted by mounting means 21 onto frame 2 and fixed firmly thereby. The load to be bundled is positioned on load platform 4, locating the load over space 14 at the desired bundling position on load 5. Tape 7 at its loose end is pulled under load 5 but over anvil plates 18 underside as shown in FIG. 3. The air cylinder 19 is selectively activated by any conventional means to move anvil plates 18 inward toward the center thereby substantially closing off space 14 beneath, load 5. Gripper arms 15 and knife blade 21 are still in the rest position. Knife blade 21 is focally mounted on focal means 23 which is adapted to move knife blade 21 to its down or up position (as shown in FIG. 7). A feature of the novel hot knife 21 is that it is heated by secondary means; a separate heater 22 supplies heat through contact in the rest position. This avoids troublesome flexing of wires and other problems associated with prior art moving hot wire knives. Knife blade 21 is raised by a pivoted lever action, actuated by an air cylinder as described elsewhere throughout this disclosure. The next step is to activate gripper arms 15 moving them to the up position where gripper pads 17 are secured against tape 7 at its underside as shown in FIG. 4 thereby pinching tape 7 between gripper pads 17 and anvil plates 18 which are still in the closed position. Both gripper arms 15 and anvil plates 18 are in the in or closed position, that is, both arms 15 and plates 18 are positioned toward the center of gripper assembly 8, whereas in FIG. 2 they are both shown to be in the out or open position disposed away from the center of the device. As anvil plates 18 and gripper pads 17 firmly pinch tape 7 therebetween, anvil plates 18 and gripper arms 15 are moved outwardly to the open position thereby stretching tape 7 in their grip and forming tails 24 as it stretches the tape sides outwardly. By retracting gripper arms 15 and anvil plates 18 outwardly, space 14 is now available for additional wraps of tape therethrough. Thus, tape 7 is held initially for beginning the wrap or bundling pulling tape 7 from its reel or roll as ring 3 rotates around load 5. In FIG. 6 subsequent wraps are put around load 5 over the initial wrap or strip of tape having tails 24. Since anvil plates 18 and gripper arms 15 are in the open position, space 14 is available for additional wraps or bands of tape 7 to be put around load 5. As many wraps as rotation of ring 3 will be applied on load 5 during the bundling operation. After the desired number of wraps are applied upon load 5, the activating means 12 is turned off and the rotation of ring 3, wrapping and dispensing of tape 7 from dispenser 6 stops. The tape 7 is now ready to be but to free load 5 from the tape 7 spool or web. In FIG. 7, knife blade 21 is raised by this process. At the start of the last desired wraps, the anvil plates are extended. The activating means is turned off at completion of the cycle so that the tape comes to rest stretched across under the anvils. The grippers are caused to close to grip the film to the anvils. A fraction of a second later, the cutter is pivoted up to sever the stretched tape while a pad, mounted with the blade, presses the free cut end of the tape against the film around the bundle. It is significant that the cutter knife is caused to strike close to the anvil plates to pass slightly above them which creates greatly increased localized tension in the film at this point, similar to what might be demonstrated by attempting to cut the film loose with a pair of scissors. This localized tension enhances the cutting action allowing lower blade temperatures to be used. Without the "loose scissors" tension effect, at the temperatures used, the wrap would only soften and elongate without severing. The hot blade is not caused to strike the anvils because the cool anvils negate the heat knife effect, again requiring the undesirable heat levels which are counterproductive due to charring and residual buildup which can occur and interfere with the severing as well as possibly generating noxious fumes and smoke. True sharp edge scissors or perforating blade cutting methods are not employed because of the problems of maintaining sharp edges. The cutting method used in the invention is a unique blend of common methods resulting in an exceptionally durable, reliable, safe, simple and maintenance-free device, avoiding the pitfalls of the present genre of cutting devices. The knife blade 21 is raised by a pivoted lever action, actuated by an air cylinder as described elsewhere throughout this disclosure. After the tape 7 is cut, the cycle of FIGS. 2 to 7 is repeated until the desired number of loads have been bundled.

The preferred and optimumly preferred embodiments of the present invention have been described herein and shown in the accompanying drawing to illustrate the underlying principles of the invention but it is to be understood that numerous modifications and ramifications may be made without departing from the spirit and scope of this invention.

What is claimed is:

1. A stretch bundler comprising a frame, a rotatable ring, a load platform, a film dispenser and film gripping means, said rotatable ring disposed along a vertical plane perpendicular to the horizontal plane of said load platform, said rotatable ring movably attached to the interior of said frame and disposed on a parallel plane to the plane of said frame, said film dispenser mounted on the inner periphery of said ring and adapted to hold a spool of a substantially narrow film or tape, said load platform having an opening along its entire horizontal surface, said opening of sufficient width to accommodate passage of said tape therethrough, said film gripping means comprising an assembly disposed below said load platform, said assembly comprising at least two movable gripper arms and at least two movable anvil plates, both said gripper arms and said anvil plates movable toward and away from the center of said opening, said gripper arms and said anvil plates having means to hold a film strip therebetween and stretch said film strip while still retaining it, both are retracted away from the center of said opening, said rotatable ring connected to a suitable source of power which rotates said ring upon command and thereby dispenses tape around a load.

2. The stretch bundler of claim 1 wherein said gripper arms are pivotly mounted on means providing an up and down position in addition to said movement toward and away from the center of said opening.

3. The stretch bundler of claim 1 wherein said gripper arms have on their terminal portions gripper pads, said pads being the portion of said gripper arms that will contact said film strip or tape.

4. The stretch bundler of claim 1 wherein said anvil plates and said gripper arms having means to pinch said film strip or tape therebetween.

5. The stretch bundler of claim 1 wherein said anvil plates and said gripper arms having means to hold securely said film strip and stretch it outwardly beyond the width of said opening.

6. The stretch bundler of claim 1 wherein said anvil plates and said gripper arms having means to release said film strip upon command.

7. The stretch bundler of claim 1 wherein said anvil plates and said gripper arms having moving means to reposition said anvil plates and said gripper arms away from a path of said film strip during a wrapping operation.

8. The stretch bundler of claim 1 wherein said anvil plates are located below and on a plane parallel to said load platform.

9. The stretch bundler of claim 1 wherein said gripper arms are located below said anvil plates and having means to be moved in a position coextensive with said anvil plates.

10. A stretch bundler comprising in combination a main frame, a rotatable ring, a load platform, a film dispenser and a film gripping assembly, said main frame on a plane perpendicular to the ground and having a box-like configuration with an access opening to said load platform, said rotatable ring fixed to the inside of said main frame and having means to rotate along a plane parallel to the vertical plane of said main frame, said rotatable ring in friction contact with a drive wheel, said drive wheel in power contact with a source of power and adapted to be activated upon command, said load platform positioned inside said main frame on a plane perpendicular to the vertical plane of said ring, said load platform having along its entire horizontal surface an opening suitable to accommodate passage of a film strip therethrough, said film dispenser mounted on the interior of said rotatable ring and having means to house and dispense said film strip to a position abutting said load platform, said film gripping assembly located below said load platform and comprising at least two anvil plates and at least two gripper arms, said anvil plates substantially parallel to the longitudinal surface of said load platform and movable along a plane parallel to said surface, said gripper arms located below said anvil plates and coextensively movable with said anvil plates, said anvil plates and said gripper arms movable toward and away from the center of said opening in said load platform.

11. The stretch bundler of claim 10 wherein said gripper arms are pivotly mounted on means providing an up and down position in addition to said movement toward and away from the center of said opening.

12. The stretch bundler of claim 10 wherein said gripper arms have on their terminal portions gripper pads, said pads being the portion of said gripper arms that will contact said film strip or tape.

13. The stretch bundler of claim 10 wherein said anvil plates and said gripper arms having means to pinch said film strip or tape therebetween.

14. The stretch bundler of claim 10 wherein said anvil plates and said gripper arms having means to hold securely said film strip and stretch it outwardly beyond the width of said opening.

15. The stretch bundler of claim 10 wherein said anvil plates and said gripper arms having means to release said film strip upon command.

16. The stretch bundler of claim 10 wherein said anvil plates and said gripper arms having moving means to reposition said anvil plates and said gripper arms away from a path of said film strip during a wrapping operation.

17. The stretch bundler of claim 10 wherein said anvil plates are located below and on a plane parallel to said load platform.

18. The stretch bundler of claim 10 wherein said gripper arms are located below said anvil plates and having means to be moved in a position coextensive with said anvil plates.

* * * * *

UNITED STATES PATENT AND TRADEMARK OFFICE

CERTIFICATE OF CORRECTION

PATENT NO. : 4,850,177

DATED : July 25, 1989

INVENTOR(S) : James W. Laczkowski et al

It is certified that error appears in the above-identified patent and that said Letters Patent is hereby corrected as shown below:

On the title page under United States Patent Item (19), "Kaczkowski, et al" should read -- Laczkowski, et al --.

On the title page after "Attorney, Agent or Firm" "James J. Balabate" should read -- James J. Ralabate --.

Signed and Sealed this

Twenty-seventh Day of March, 1990

*Attest:*

JEFFREY M. SAMUELS

*Attesting Officer*

*Acting Commissioner of Patents and Trademarks*